US007255201B2

(12) United States Patent
Rieder et al.

(10) Patent No.: US 7,255,201 B2
(45) Date of Patent: Aug. 14, 2007

(54) LIFTING FRAME WITH HYDRAULIC LINES FOR AN ACCESSORY HYDRAULIC SYSTEM

(75) Inventors: Klaus Rieder, Hösbach (DE); Edmund Heiter, Röllbach (DE)

(73) Assignee: Linde Aktiengesellschaft, Wiesbaden (DE)

( * ) Notice: Subject to any disclaimer, the term of this patent is extended or adjusted under 35 U.S.C. 154(b) by 501 days.

(21) Appl. No.: 10/686,014

(22) Filed: Oct. 15, 2003

(65) Prior Publication Data

US 2004/0134715 A1 Jul. 15, 2004

(30) Foreign Application Priority Data

Oct. 18, 2002 (DE) ..... 102 48 669

(51) Int. Cl.
*B66F 9/06* (2006.01)

(52) U.S. Cl. ..... 187/228; 187/234; 187/238; 414/592; 414/918

(58) Field of Classification Search ..... 187/228; 254/414; 414/592, 918; 137/565.19, 599.02
See application file for complete search history.

(56) References Cited

U.S. PATENT DOCUMENTS 2,791,293 A * 5/1957 Schenkelberger ..... 187/228
3,195,751 A * 7/1965 Meyers et al. ..... 414/607
3,462,028 A 8/1969 Pi
3,612,318 A * 10/1971 Ramsey ..... 187/228
4,244,449 A 1/1981 Renk et al.
4,553,638 A 11/1985 Ray
5,992,571 A * 11/1999 Lee ..... 187/228
6,505,710 B1 * 1/2003 Kato ..... 187/230

FOREIGN PATENT DOCUMENTS

DE 43 35 275 A1 4/1995
FR 1 429 685 A 2/1966

* cited by examiner

*Primary Examiner*—Gene O. Crawford
*Assistant Examiner*—Stefan Kruer
(74) *Attorney, Agent, or Firm*—The Webb Law Firm

(57) ABSTRACT

A lifting frame has a stationary vertical mast (outer mast 1), at least one telescoping lifting mast (inner mast 3), and a lifting carriage (4) movable on the lifting mast. At least one hydraulic line (5) installed on the lifting frame discharges at the lifting carriage (4). When the lifting frame is in the retracted position, the hydraulic line (5) forms a loop (S) which is open on top. The hydraulic line (5) is guided in the vicinity of the loop (S) by a tensioning pulley (6) that dips from above into the loop (S). The tensioning pulley (6) is fastened to a pulley carrier (7). The weight of the pulley carrier can be used to generate a bias force that is exerted on the hydraulic line (5), or drive means connected with the pulley carrier (7) can be provided.

16 Claims, 1 Drawing Sheet

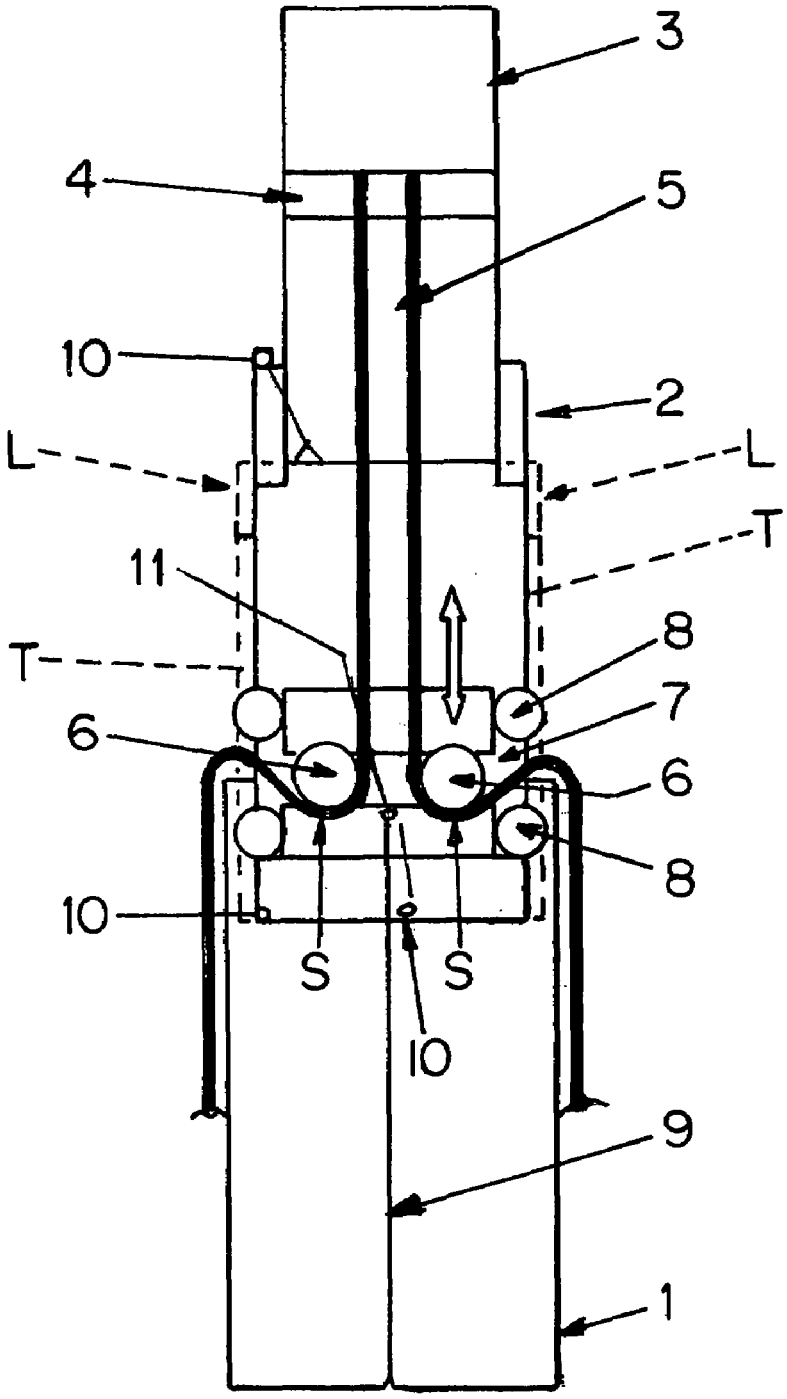
3
4
5
10
2
L
L
T
11
T
8
7
6
6
8
10
S
S
10
9
1

LIFTING FRAME WITH HYDRAULIC LINES FOR AN ACCESSORY HYDRAULIC SYSTEM

CROSS REFERENCE TO RELATED APPLICATION

This application corresponds to German Application No. 102 48 669.7 filed Oct. 18, 2002, which is herein incorporated by reference in its entirety.

BACKGROUND OF THE INVENTION

1. Field of the Invention

This invention relates to a lifting frame comprising a vertical mast, at least one telescoping lifting mast, and a lift carriage that can be moved up and down on the lifting mast. An accessory hydraulic system can be fastened to the lift mast. At least one hydraulic line discharges at the lift carriage, is installed on the lifting frame, and forms a loop that is open on the top.

2. Technical Considerations

The term "hydraulic line" as used herein includes what are technically called "dual lines", i.e., a system having two parallel hydraulic lines that are connected to each other and which are generally used as the delivery line and the return line for hydraulic fluid for equipment that uses hydraulic power.

DE 43 35 275 A1 describes a lifting frame which is in the form of a triplex lifting frame. The hydraulic lines for a single-line or dual-line accessory hydraulic system are installed on the lifting frame by means of guide rails (i.e., sections that are open on the side). In this case, the hydraulic lines are inserted, starting from a connection to the vehicle, into the upper end of a guide rail that is fastened to the stationary outer mast (vertical mast) and on the lower end form an open loop before they enter a second guide rail from below. The second guide rail is fastened to the telescoping center mast (lifting mast). The guide rails prevent the hydraulic lines from whipping back and forth and from being squashed when the lifting frame is retracted.

The system described above is complex and expensive to manufacture and install. The guide rails also permanently restrict the driver's field of view in the vicinity of the mast columns of the lifting frame.

The known art also describes how hydraulic lines for an accessory hydraulic system can be wound up on a hose reel and unrolled against spring tension. However, a hose reel cannot be installed inside the dimensions of the lifting frame and, therefore, requires space that must be made available at suitable points of the industrial truck. This limits the amount of space available for the installation of other important components. Seals are also necessary on account of the manner in which the hydraulic line is stored (rotary feed-through), and these seals can fail during operation.

Therefore, it is an object of the invention to provide a lifting frame of the general type described above but which, using simple means and occupying a small amount of space, reduces the time, effort, and expense of installing the hydraulic line for the accessory hydraulic system and which also restricts the operator's field of view as little as possible.

SUMMARY OF THE INVENTION

The invention provides a lifting frame having a hydraulic line that is guided in the vicinity of the loop by means of a tensioning pulley that dips into the loop, is fastened to a pulley carrier that can move vertically (up and down) on the lifting frame, and by means of which a bias force can be applied to the hydraulic line.

The invention, therefore, teaches that a vertically movable device that is fastened to the lifting frame can be used to apply a downwardly directed bias force on the hydraulic line. The hydraulic line is thereby always oriented in a defined position, in which the applied bias force prevents it from being whipped back and forth.

The time, effort, and expense required for manufacture, installation, and assembly are reduced by the lifting frame of the invention. The operator's visibility is less severely restricted than with the known lifting frame designs having guide rails as described above. While on the known lifting frame a loop must still be present even when the hydraulic line is fully extended, this is not the case with the lifting frame of the invention. Therefore, less material is required for the hydraulic line.

The weight of the pulley carrier can also be advantageously used to generate the bias force that is exerted on the hydraulic line.

If the weight of the pulley carrier is not sufficient to produce a desired bias force on the hydraulic line, additional weights can be attached to the pulley carrier.

In an additional advantageous development of the invention, drive means can be provided to generate a bias force that is exerted on the hydraulic line. The drive means can be effectively connected with the pulley carrier. A bias force can, therefore, be exerted on the hydraulic line regardless of the weight of the pulley carrier (optionally in addition to the weight of the pulley carrier).

With regard to a simple and functionally reliable construction, the invention teaches that a tensioning cable can be fastened to the stationary vertical mast and to the lifting mast and can be effectively connected with the pulley carrier.

As the lifting mast is retracted and extended, the pulley carrier is thereby necessarily moved up and down with it, as a result of which the hydraulic line is always held under a uniform bias force.

The effort and expense for the guidance of the pulley carrier on the lifting frame can be minimized if the pulley carrier is mounted so that it can move vertically (e.g., up and down on the lifting frame) by means of guide rollers on the cylinder tubes of the lifting cylinders that are located on both sides. The guide rollers can have a concave profile that matches the outside diameter of the cylinder tubes of the lifting cylinders. Therefore, a separate guide profile on the lifting frame is not necessary.

In one embodiment of the invention, the lifting frame is in the form of a triplex mast with an outer mast, a center mast, and an inner mast. On each side of the center mast there is a lifting cylinder to raise the inner mast. The pulley carrier can be mounted by means of guide rollers on the cylinder tubes of the lifting cylinders. Alternatively, it is also possible to configure the lifting frame of the invention in the form of a duplex lifting frame.

If the pulley carrier is provided with two tensioning pulleys, each of which guides at least one hydraulic line, the accessory hydraulic system to be supplied with hydraulic fluid can be in the form of a dual-line accessory hydraulic system. One of the two hydraulic lines is thereby guided by each tensioning pulley.

The tensioning pulleys can be installed in mirror symmetry. The result is a uniform load on the pulley carrier.

BRIEF DESCRIPTION OF THE DRAWING

Additional advantages and features of the invention are described in greater detail below with reference to the exemplary embodiment which is illustrated in the accompanying drawing.

DESCRIPTION OF THE PREFERRED EMBODIMENT

In the exemplary embodiment depicted in the drawing, the lifting frame is in the form of a triplex lifting frame having an outer mast 1 (stationary mast), a telescoping center mast 2 (center or first lifting mast), and a telescoping inner mast 3 (inner or second lifting mast). The invention can also be used on duplex lifting frames, in which there is only one telescoping mast part and one stationary mast part.

A lifting carriage 4 can move on the inner mast 3 by conventional means, such as a middle cylinder (not illustrated in the FIGURE). Hydraulic lines 5 for an accessory hydraulic system, in this exemplary embodiment two dual lines for a dual-line accessory hydraulic system, discharge at the lifting carriage 4. The hydraulic lines 5 are installed on the lifting frame so that when they are in the retracted position, they each form a loop S that is open on the top. When the lifting frame is extended, the two lines (loops S) travel upwardly and when the lifting frame is retracted, the two lines travel downwardly.

The invention teaches that at least one tensioning pulley 6, which is fastened to a pulley carrier 7, dips from above into each of the loops S of the hydraulic lines. The pulley carrier 7 can be mounted so that it can move vertically on the center mast 2 by means of two or more guide rollers 8 which are installed at some spaced, e.g., vertical, distance from each other. The guide rollers 8 advantageously can run over the surfaces of the cylinder tubes T of two lifting cylinders L fastened to the side of the center mast 2, and by means of which the inner mast 3 can be extended and retracted. For this purpose, the guide profiles can have a concave profile that matches the outside diameter of the cylinder tubes T.

The pulley carrier 7 exerts a bias force on the hydraulic lines 5. The bias force can be generated, for example, by the weight of the pulley carrier 7.

It is also possible, however, to provide drive means for this purpose, for example, drive means like the ones illustrated in the drawing. The ends of a tensioning cable 9 can be fastened to the outer mast 1 and to the inner mast 3. The tensioning cable 9 runs over one or more deflector pulleys 10 which can be fastened to the center mast 2 and over a deflector pulley 11 which is connected with the pulley carrier 7. As a result of this arrangement, the pulley carrier 7 is automatically raised and lowered as the lifting frame is retracted and extended, whereby it retains its position relative to the loops S and is thus always able to exert a bias force to keep the hydraulic lines 5 taut.

In the drawing, the lifting frame has not yet been fully extended. In this position, loops S are still present which loop around the tensioning pulleys 6 by up to 180 degrees. It is possible to design the length of the hydraulic lines 5 so that when the lifting frame is in the fully extended position, the looping is significantly less. In which case, the hydraulic lines 5 can be deflected by the tensioning pulleys 6 at an angle which is only approximately 90 degrees. The hydraulic lines 5 are thereby only deflected at right angles.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A lifting frame, comprising:

a stationary vertical mast and at least one telescoping lifting mast;

a lifting carriage that can be moved up and down on the lifting mast;

an accessory hydraulic system fastened to the lifting carriage;

at least one hydraulic line that discharges at the lifting carriage, which hydraulic line is installed on the lifting frame and forms a loop that is open toward the top; and a pulley carrier comprising at least one tensioning pulley, wherein the pulley carrier is movable up and down on the lifting frame, wherein at least one hydraulic line is guided in the vicinity of the loop over the tensioning pulley that dips from above into the loop such that a bias force is exerted on the hydraulic line, and wherein the pulley carrier is mounted so that it can move up and down by means of guide rollers on cylinder tubes of lifting cylinders that are located on opposite sides of the lifting mast.

2. The lifting frame as claimed in claim 1, wherein the weight of the pulley carrier generates the bias force that is exerted on the hydraulic line.

3. The lifting frame as claimed in claim 1, including drive means effectively connected to the pulley carrier to generate the bias force that is exerted on the hydraulic line.

4. The lifting frame as claimed in claim 1, wherein the lifting frame is a triplex lifting frame comprising an outer mast, a center mast, and an inner mast.

5. The lifting frame as claimed in claim 1, wherein the pulley carrier includes two tensioning pulleys, over each of which at least one hydraulic line is guided.

6. The lifting frame as claimed in claim 2, including drive means effectively connected to the pulley carrier to generate a bias force that is exerted on the hydraulic line.

7. The lifting frame as claimed in claim 2, wherein the lifting frame is a triplex lifting frame comprising an outer mast, a center mast, and an inner mast.

8. The lifting frame as claimed in claim 2, wherein the pulley carrier includes two tensioning pulleys, over each of which at least one hydraulic line is guided.

9. The lifting frame as claimed in claim 3, including a tensioning cable fastened to the stationary vertical mast and to the lifting mast, and the tensioning cable is effectively connected with the pulley carrier.

10. The lifting frame as claimed in claim 3, wherein the lifting frame is a triplex lifting frame comprising an outer mast, a center mast, and an inner mast.

11. The lifting frame as claimed in claim 3, wherein the pulley carrier includes two tensioning pulleys, over each of which at least one hydraulic line is guided.

12. The lifting frame as claimed in claim 9, wherein the lifting frame is a triplex lifting frame comprising an outer mast, a center mast, and an inner mast.

13. The lifting frame as claimed in claim 9, wherein the pulley carrier includes two tensioning pulleys, over each of which at least one hydraulic line is guided.

14. The lifting frame as claimed in claim 5, wherein the tensioning pulleys are oriented in mirror symmetry.

15. A lifting frame, comprising:

a stationary vertical mast and at least one telescoping lifting mast;

a lifting carriage that can be moved up and down on the lifting mast;

an accessory hydraulic system fastened to the lifting carriage;

at least one hydraulic line that discharges at the lifting carriage, which hydraulic line is installed on the lifting frame and forms a loop that is open toward the top;

a pulley carrier comprising at least one tensioning pulley, wherein the pulley carrier is movable up and down on the lifting frame, and wherein at least one hydraulic line is guided in the vicinity of the loop over the tensioning pulley that dips from above into the loop such that a bias force is exerted on the hydraulic line;

a drive means effectively connected to the pulley carrier to generate the bias force that is exerted on the hydraulic line; and a tensioning cable fastened to the stationary vertical mast and to the lifting mast, and the tensioning cable is effectively connected with the pulley carrier.

16. A lifting frame, comprising:

a stationary vertical mast and at least one telescoping lifting mast;

a lifting carriage that can be moved up and down on the lifting mast;

an accessory hydraulic system fastened to the lifting carriage;

at least one hydraulic line that discharges at the lifting carriage, which hydraulic line is installed on the lifting frame and forms a loop that is open toward the top;

a pulley carrier comprising at least one tensioning pulley, wherein the pulley carrier is movable up and down on the lifting frame, and wherein at least one hydraulic line is guided in the vicinity of the loop over the tensioning roller that dips from above into the loop such that a bias force is exerted on the hydraulic line; and wherein the lifting frame is a triplex lifting frame comprising an outer mast, a center mast, and an inner mast, and wherein a lifting cylinder to raise the inner mast is located on both sides of the center mast, and wherein the pulley carrier is mounted by means of guide rollers on cylinder tubes of the lifting cylinders.

* * * * *